US010441864B1

(12) United States Patent
Johnson et al.

(10) Patent No.: US 10,441,864 B1
(45) Date of Patent: Oct. 15, 2019

(54) GOLF PUTTING AID APPARATUS

(71) Applicant: Against The Grain Golf, LLC, Northbrook, IL (US)

(72) Inventors: Raymond Kenneth Johnson, Northbrook, IL (US); Justin Kutz, Princeton, WI (US)

(73) Assignee: AGAINST THE GRAIN GOLF, LLC, Northbrook, IL (US)

( * ) Notice: Subject to any disclaimer, the term of this patent is extended or adjusted under 35 U.S.C. 154(b) by 0 days.

(21) Appl. No.: 15/974,239

(22) Filed: May 8, 2018

Related U.S. Application Data

(63) Continuation-in-part of application No. 15/481,384, filed on Apr. 6, 2017, now abandoned.

(60) Provisional application No. 62/318,898, filed on Apr. 6, 2016.

(51) Int. Cl.
*A63B 69/36* (2006.01)

(52) U.S. Cl.
CPC ..... *A63B 69/3676* (2013.01)

(58) Field of Classification Search
USPC ..... 473/218, 219, 257–270, 278, 279
See application file for complete search history.

(56) References Cited

U.S. PATENT DOCUMENTS

| | | | | |
|---|---|---|---|---|
| 2,461,601 | A | 2/1949 | Hendricks | |
| 5,131,659 | A | 7/1992 | Lindberg, Jr. | |
| 5,332,211 | A * | 7/1994 | Rife | A63B 69/3676 273/DIG. 21 |
| 5,769,732 | A | 6/1998 | O'Neal | |
| 6,503,152 | B1 | 1/2003 | Pelz | |
| 7,431,661 | B1 * | 10/2008 | Cailey | A63B 60/22 473/257 |
| 7,597,632 | B2 * | 10/2009 | Edwards | A63B 69/3641 473/257 |
| 2002/0082106 | A1 * | 6/2002 | Czaja | A63B 69/3641 473/258 |
| 2003/0148815 | A1 * | 8/2003 | Swistock | A63B 24/0003 473/257 |
| 2004/0063512 | A1 | 4/2004 | Scott et al. | |
| 2005/0215342 | A1 | 9/2005 | Edwards et al. | |
| 2006/0128492 | A1 | 6/2006 | Hourihan et al. | |

* cited by examiner

*Primary Examiner* — Nini F Legesse
(74) *Attorney, Agent, or Firm* — Neal, Gerber & Eisenberg LLP; James P. Muraff

(57) ABSTRACT

Method and apparatus are disclosed for golf putting aid apparatus. An example golf putting aid includes a base configured to rest on a ground surface. The base has a first end and a second end opposite the first end. The example golf putting aid also includes a curved body supported by the base and defining a convex surface that extends in a direction between the first end and the second end of the base. When the base is rested on the ground surface, the convex surface is positioned relative to the ground surface to engage a toe of a putter head of a golf club as a user performs a putting motion to guide the putting motion.

20 Claims, 6 Drawing Sheets

GOLF PUTTING AID APPARATUS

CROSS-REFERENCE TO RELATED APPLICATION

This application is a continuation-in-part of U.S. patent application Ser. No. 15/481,384, filed on Apr. 6, 2017, that claims benefit of U.S. Provisional Patent Application No. 62/318,898, filed on Apr. 6, 2016, each of which is hereby incorporated by reference in its entirety.

TECHNICAL FIELD

The present disclosure generally relates to golfing equipment and, more specifically, to golf putting aid apparatus.

BACKGROUND

Golf is a sport in a which a player uses one or more clubs to hit a ball into a series of holes on a golf course. Some golf clubs include woods or drivers that typically are used to hit the ball from a tee. Other golf clubs include irons that are used to hit the ball from a plurality of golf course surfaces such as a fairway, rough, a sand trap, etc. Other golf clubs include putters that are used to put the ball along a putting green toward and/or into a hole. Golf players oftentimes practice their swinging and putting motions to develop a more consistent golf stroke. In some instances, golf players use various training equipment to develop their golf stroke.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for golf putting aid apparatus. An example disclosed golf putting aid includes a base configured to rest on a ground surface. The base has a first end and a second end opposite the first end. The example disclosed golf putting aid also includes a curved body supported by the base and defining a convex surface that extends in a direction between the first end and the second end of the base. When the base is rested on the ground surface, the convex surface is positioned relative to the ground surface to engage a toe of a putter head of a golf club as a user performs a putting motion to guide the putting motion.

Another example disclosed golf putting aid includes a base configured to rest on a ground surface. The base has a first end and a second end opposite the first end. The example disclosed golf putting aid also includes a rounded body supported by the base and having a guiding surface. The guiding surface is at least partially cylindrical and extends in a direction between the first end and the second end of the base. When the base is rested on the ground surface, the guiding surface is positioned relative to the ground surface to engage a toe of a putter head of a golf club as a user performs a putting motion to guide the putting motion.

BRIEF DESCRIPTION OF THE DRAWINGS

For a better understanding of the invention, reference may be made to embodiments shown in the following drawings.

The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
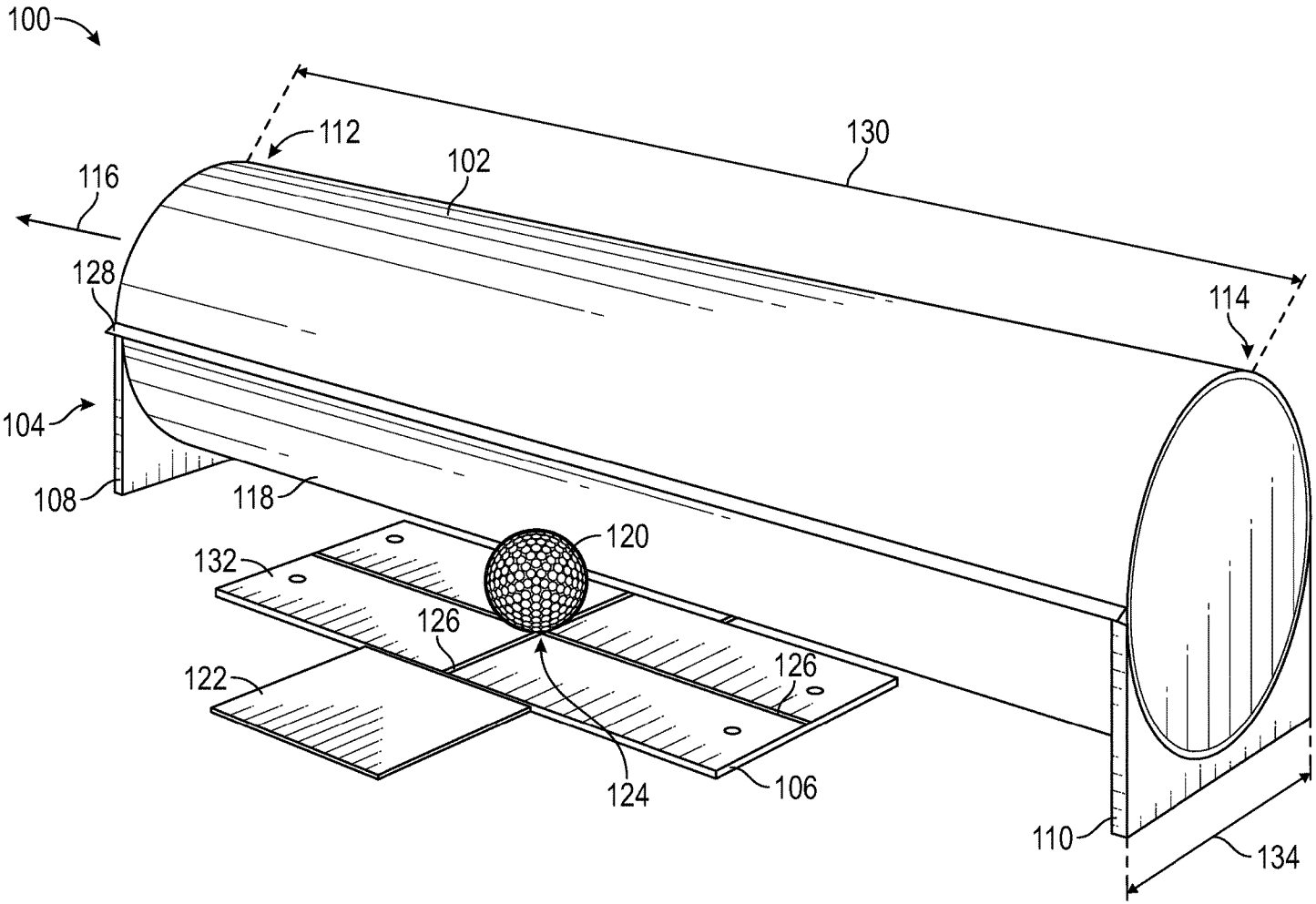
FIG. 1 illustrates an example putting aid in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Golf is a sport in a which a player uses one or more clubs to hit a ball into a series of holes on a golf course. Some golf clubs include woods or drivers that typically are used to hit the ball from a tee. Other golf clubs include irons that are used to hit the ball from a plurality of golf course surfaces such as a fairway, rough, a sand trap, etc. Other golf clubs include putters that are used to put the ball along a putting green toward and/or into a hole. Golf players oftentimes practice their swinging and putting motions to develop a more consistent golf stroke. In some instances, golf players use various training equipment to develop their golf stroke. For example, some golf players use putting aid devices to develop a consistent putting stroke. However, golf players oftentimes find it difficult to replicate the putting stroke on a golf course without use of such putting aid devices.

Examples disclosed herein include a training aid for golfers to improve their putting in golf. The aid provides a method to improve the putting stroke. For example, traditional putting aids oftentimes are heel oriented, and this putting aid is more toe oriented and provides a path to improvement through intuitive feel. The examples disclosed herein reduce and/or eliminate a force feel of traditional putting aids by producing a solution for improved putting through intuitive feel. The examples disclosed herein facilitate a golfer in developing sound mechanics with an intuitive feel to improve the putting stroke of the golfer.

Some examples disclosed herein include one or more end caps (e.g., threaded end caps), a putting path cylinder, a visual aid, one or more end stands, a mirrored putting pad, a slide, removable spikes, and/or a golf ball. The putting path cylinder serves as both the container for the components and the body onto which the end caps couple (e.g., onto which threaded end caps thread) and into which the slide fits. Further, the mirrored putting pad attaches to the slid.

In such examples, to assemble the aid, one or more of the end caps is removed from the putting path cylinder and the slide and the mirrored putting pad are removed from the putting path cylinder. The one or more of the end caps may be threaded back onto the putting path cylinder. The slide is inserted into the putting path cylinder, and the mirrored putting pad is attached to the slide.

Some examples disclosed herein include an integrally formed base and curved body. In such examples, the base includes a flat surface that rests on a ground surface. The curved body extends from the base and includes a guiding surface along which a toe of a putter head is to slide during a putting motion.

To utilize an aid of examples disclosed herein, a user places a golf ball on the ground next to the aid (e.g., by placing the ball on a ball dimple located in crosshairs of a mirrored putting pad). The user then addresses the ball by placing the putter head behind the ball such that the putter rests with a toe or nose of the putter underneath and against the surface of the putting path body. The aid guides the user in making a proper putting stroke motion such that the putter toe remains against the wall of the putting path body throughout the entirety of his or her putting motion. For example, the putting path body of the aid intuitively forces or causes the user to swing a putter head on a type of arc that players try to achieve with an inside-to-inside putting motion. Additionally, the putting path body of the aid intuitively forces the user to swing the putter head down and through impact to promote a desired moment of impact with the golf ball. The aid provides instant feedback to the user to facilitate the user in identifying or sensing where the ball contacts the putter face, which enables the user to more easily identify miss-hits of the ball and/or stroke path issues of the putter head.

The examples disclosed herein may be made by utilizing an injection molding device with molds dedicated to each component. A user may utilize the aid both at a golf course or any other area suitable to set up the aid and make a putting stroke. The device is helpful both in an actual practice setting with a golf ball and putting or without a golf ball just making practice putting strokes.

Turning to the figures, FIG. 1 illustrates an example putting aid 100 when assembled in accordance with the teachings herein. In the illustrated example, the putting aid 100 includes an at least partial cylinder 102. In other examples, the putting aid 100 includes a partial cylinder. Further, the putting aid 100 includes one or more stands 104 and a putting pad 106.

When the putting aid 100 is assembled as illustrated in FIG. 1, the at least partial cylinder 102 rests on the stands 104. In the illustrated example, the stands 104 include an end stand 108 (e.g., a first end stand) and an end stand 110 (e.g., a second end stand) opposite the end stand 108. An end 112 (e.g., a first end) of the at least partial cylinder 102 rests on the end stand 108, and an end 114 (e.g., a second end) opposite the end 112 rests on the end stand 110. That is, a base of the putting aid 100 is formed, at least partially, by the end stand 108 and the end stand 110. As illustrated in FIG. 1, each of the end stand 108 and the end stand 110 include a flat surface that is configured to engage a ground surface. Further, the at least partial cylinder 102 rests on or otherwise couples to the stands 104 and is configured to extend in a direction 116 along a ground surface. That is, the at least partial cylinder 102 is a curved and/or rounded body that is supported by the base formed, at least partially, by the end stand 108 and the end stand 110. A cylindrical surface 118 (e.g., a rounded and convex outer surface) of the at least partial cylinder 102 is configured to engage a distal end of a golf club (e.g., a toe or nose of a putter opposite a heal of the putter) as a user (e.g., a golf player) performs a putting motion to put a golf ball 120 located on the putting pad 106. Further, the putting pad 106 is positioned on the ground surface adjacent to the at least partial cylinder 102. In the illustrated example, a slide 122 of the putting aid 100 rests on the ground surface adjacent to the at least partial cylinder 102. The slide 122 receives at least a portion of the putting pad 106 to position the putting pad 106 adjacent to the at least partial cylinder 102. The putting pad 106 defines a dimple 124 and crosshairs 126 that facilitate the user in identifying the location of the dimple 124.

When the putting pad 106 is positioned adjacent to the at least partial cylinder 102, the dimple 124 is spaced apart from the at least partial cylinder 102 by a distance (e.g., a distance 304 of FIG. 3) to facilitate the cylindrical surface 118 of the at least partial cylinder 102 in engaging the distal end of the golf club to guide a putting motion of the user. That is, when the putting aid 100 is rested on the ground surface, the cylindrical surface 118 is positioned relative to the ground surface to engage the distal end of the golf club as the user performs his or her putting motion to guide the putting motion. For example, the at least partial cylinder 102 is formed of a low-friction material (i.e., material having a low friction coefficient) to enable the distal end of the golf club to slide along the cylindrical surface 118 of the at least partial cylinder 102 without impediment. In some examples, the material of the cylinder is a low-friction plastic such as polyoxymethylene, silicone, nylon, high-density polyethylene (HDPE), ultra-high-molecular-weight polyethylene (UHMW), acrylic (also referred to as poly(methyl methacrylate), PMMA, and acrylic glass), etc.

In operation, the user places the golf ball 120 on the dimple 124 of the putting pad 106. The user positions his or her feet next to the putting pad 106 such that the user's feet are substantially perpendicular to the at least partial cylinder 102 and the golf ball 120 is positioned between the user's feet and the at least partial cylinder 102. The user then places the golf club (e.g., a putter) behind the golf ball 120 such that the golf club rests on the putting pad 106 and the distal end (e.g., a toe or nose of a putter head opposite a heal of the putter head) of the golf club contacts the cylindrical surface 118 of the at least partial cylinder 102. The putting aid 100 guides the user in performing a desired putting motion by causing the distal end of the golf club to slide along the cylindrical surface 118 of the at least partial cylinder 102 through the entirety of the putting motion. That is, the putting aid 100 trains the user to develop a putting motion (e.g., an inside-to inside stroke, an inside-down-the-line stroke, a straight-back-straight-through stroke) that consistently results in solid contact with the golf ball 120. For example, the putting aid 100 causes the user to intuitively develop and retain (e.g., via muscle-memory) a putting motion that consistently results in a center portion of a face of the golf club contacting the golf ball 120. Further, the putting motion developed via the putting aid 100 causes the face of the golf club to remain relatively low throughout the putting motion to prevent the user from coming out of the putting motion early and, thus, contacting the golf ball 120 with a lower portion of the face of the golf club that potentially does not consistently result in solid contact with the golf ball 120.

Further, the at least partial cylinder 102 of the illustrated example includes a visual aid 128 (e.g., a ledge) that extends along a length 130 of the at least partial cylinder 102 to facilitate the user in observing the putting motion guided by the putting aid 100. For example, the visual aid 128 is integrally formed with and/or coupled to the at least partial cylinder 102. As illustrated in FIG. 1, the visual aid 128 divides the least partial cylinder at into a lower portion and an upper portion. For example, the lower portion defines the portion of the cylindrical surface 118 that guides the putting motion of the user, and the upper portion defines another portion of the cylindrical surface 118.

Further, in some examples, the putting pad 106 includes a reflective surface 132 to facilitate the user in observing the putting motion guided by the putting aid 100. Additionally or alternatively, the cylindrical surface 118 of the at least partial cylinder 102 is reflective to facilitate the user in observing the putting motion guided by the putting aid 100. That is, the putting aid 100 enables the user to observe what a putting motion with proper mechanics looks like to facilitate the user in replicating the putting motion during a round of golf on a golf course.

Additionally, in the illustrated example, each of the end stand 108 and the end stand 110 has a length 134 that extends a width of the at least partial cylinder 102. In other examples, the end stand 108 and/or the end stand 110 are configured such that the length 134 is less than the width of the at least partial cylinder 102. In such examples, the length 134 of the end stand 108 and/or the end stand 110 is reduced relative to the width of the at least partial cylinder 102 to create a travel path for the golf ball 120 that is parallel to the at least partial cylinder 102. For example, the end stand 108 and/or the end stand 110 is configured such that the end stand 108 and/or the end stand 110 extend short of a position of the dimple 124 to facilitate the golf ball 120 in traveling from the dimple 124 and parallel to the at least partial cylinder 102 without colliding with the end stand 108 or the end stand 110.

Figure 2:
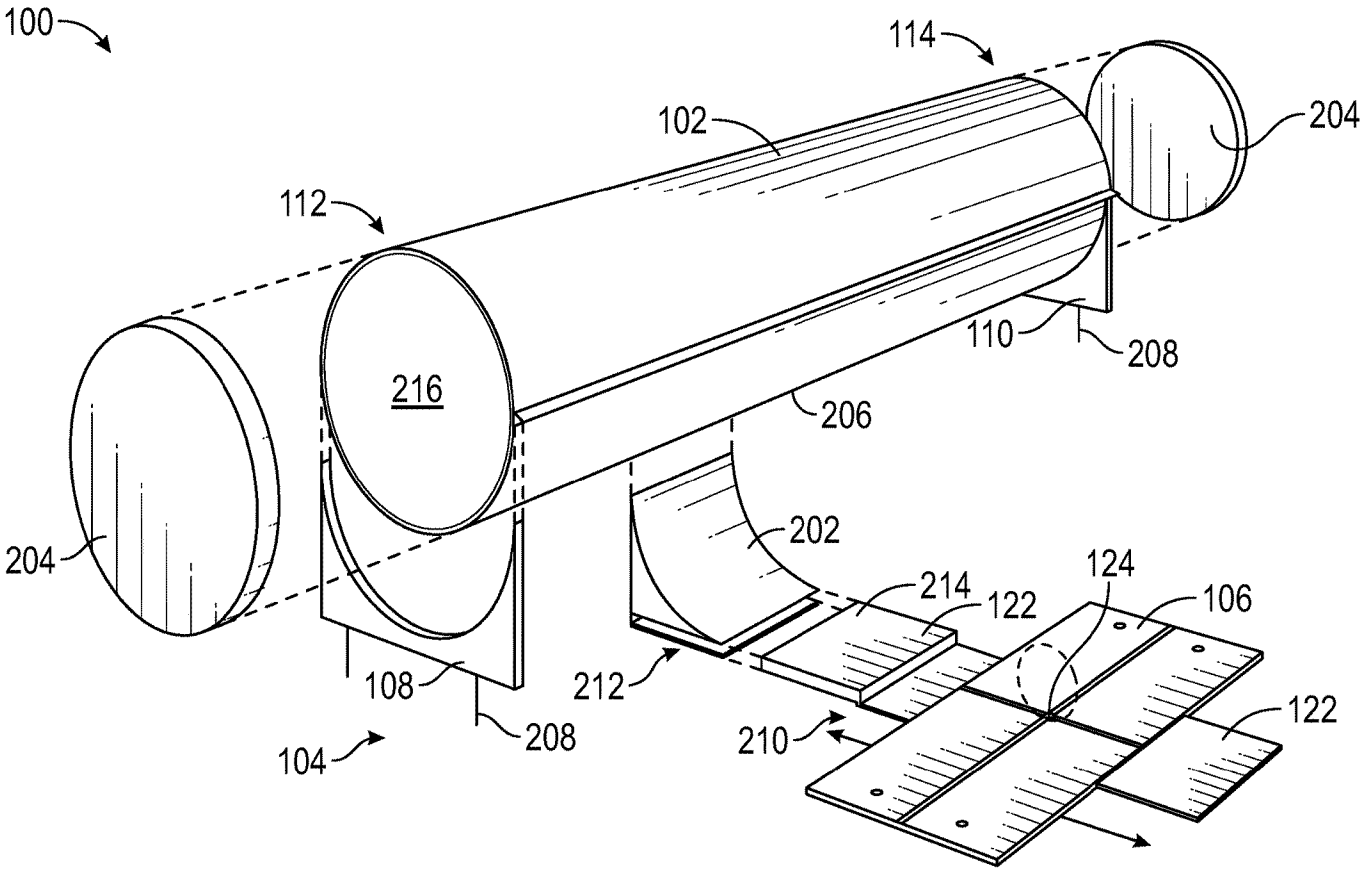
FIG. 2 is an exploded view of the putting aid of FIG. 1.

FIG. 2 is an exploded view of the putting aid 100. In the illustrated example, the putting aid 100 includes the at least partial cylinder 102, the stands 104, the putting pad 106, and the slide 122. The stands 104 include the end stand 108, the end stand 110, and a sleeve stand 202. Further, the putting aid 100 includes one or more end caps 204.

To enable assembly of the putting aid 100, the at least partial cylinder 102 is configured to rest on one or more of the stands 104. For example, the end stand 108 is configured to receive the end 112 of the at least partial cylinder 102, and the end stand 110 is configured to receive the end 114 of the cylinder. Further, the sleeve stand 202 is configured to receive a middle portion 206 of the at least partial cylinder 102. In the illustrated example, each of the end stand 108 and the end stand 110 has a substantially semi-circular surface for receiving the at least partial cylinder 102, and the sleeve stand has a substantially quarter-circular surface for receiving the at least partial cylinder 102. Further, in some examples, one or more of the stands 104 include fasteners 208 that facilitate the corresponding one or more of the stands 104 in coupling to the ground surface. In the illustrated example, the fasteners 208 are removable spikes that facilitate the end stand 108 and the end stand 110 in coupling to the ground surface.

The putting pad 106 is configured to be positioned on the ground surface adjacent to the at least partial cylinder 102. The dimple 124 is configured to receive the golf ball 120 and be spaced apart from the at least partial cylinder 102 by a distance (e.g., the distance 304 of FIG. 3) to facilitate the cylindrical surface 118 of the at least partial cylinder 102 in engaging a distal end of a golf club to guide a putting motion. To position the dimple 124 and/or the putting pad 106 defining the dimple 124 relative to the at least partial cylinder 102, the slide 122 is configured to couple to the sleeve stand 202 and rest on the ground surface adjacent to the at least partial cylinder 102, and the slide 122 defines a channel 210 that is configured to receive at least a portion of the putting pad 106. For example, the sleeve stand 202 defines a slot 212 that is configured to receive an end 214 of the slide 122 to couple the slide 122 to the sleeve stand 202. The channel 210 of the slide 122 that receives the putting pad 106 is wider than the putting pad 106 to facilitate adjustment of the putting pad 106 and, thus, the dimple 124 relative to the at least partial cylinder 102 when the at least partial cylinder 102 and the slide 122 are coupled to the sleeve stand 202. That is, the channel 210 enables the putting pad 106 to be closer to the end 214 to position the dimple 124 closer to the at least partial cylinder 102 and/or farther from the end 214 to position the dimple 124 farther from the at least partial cylinder 102. For example, the distance between the dimple 124 and the at least partial cylinder 102 (e.g., the distance 304 of FIG. 3) may be adjusted by the user to enable the putting aid 100 in guiding a putting motion of golf clubs (e.g., putters) having different shapes and/or sizes.

Further, the components of the putting aid 100 are configured to disassemble for storage. To disassemble the putting aid 100 for storage, the components of the putting aid 100 (e.g., the at least partial cylinder 102, the stands 104, the putting pad 106, the fasteners 208) are decoupled from each other. For example, the at least partial cylinder 102 is decoupled from the stands 104, the putting pad 106 is decoupled from the slide 122, and the slide 122 is decoupled from the sleeve stand 202. In the illustrated example, the at least partial cylinder 102 is a canister that is configured to store the other components of the putting aid 100 for storage. For example, the stands 104, the putting pad 106, the fasteners 208, and/or the fasteners 208 are stored in a cavity 216 defined by the canister. Further, the end caps 204 are configured to couple to the canister to enclose the other components of the putting pad 106 within the cavity 216. For example, one of the end caps 204 couples to the end 112 and/or one of the end caps 204 couples to the end 114. In some examples, the end caps 204, the end 112, and the end 114 are threaded such that one of the end caps 204 threadably couples to the end 112 and/or one of the end caps 204 threadably couples to the end 114.

Figure 3:
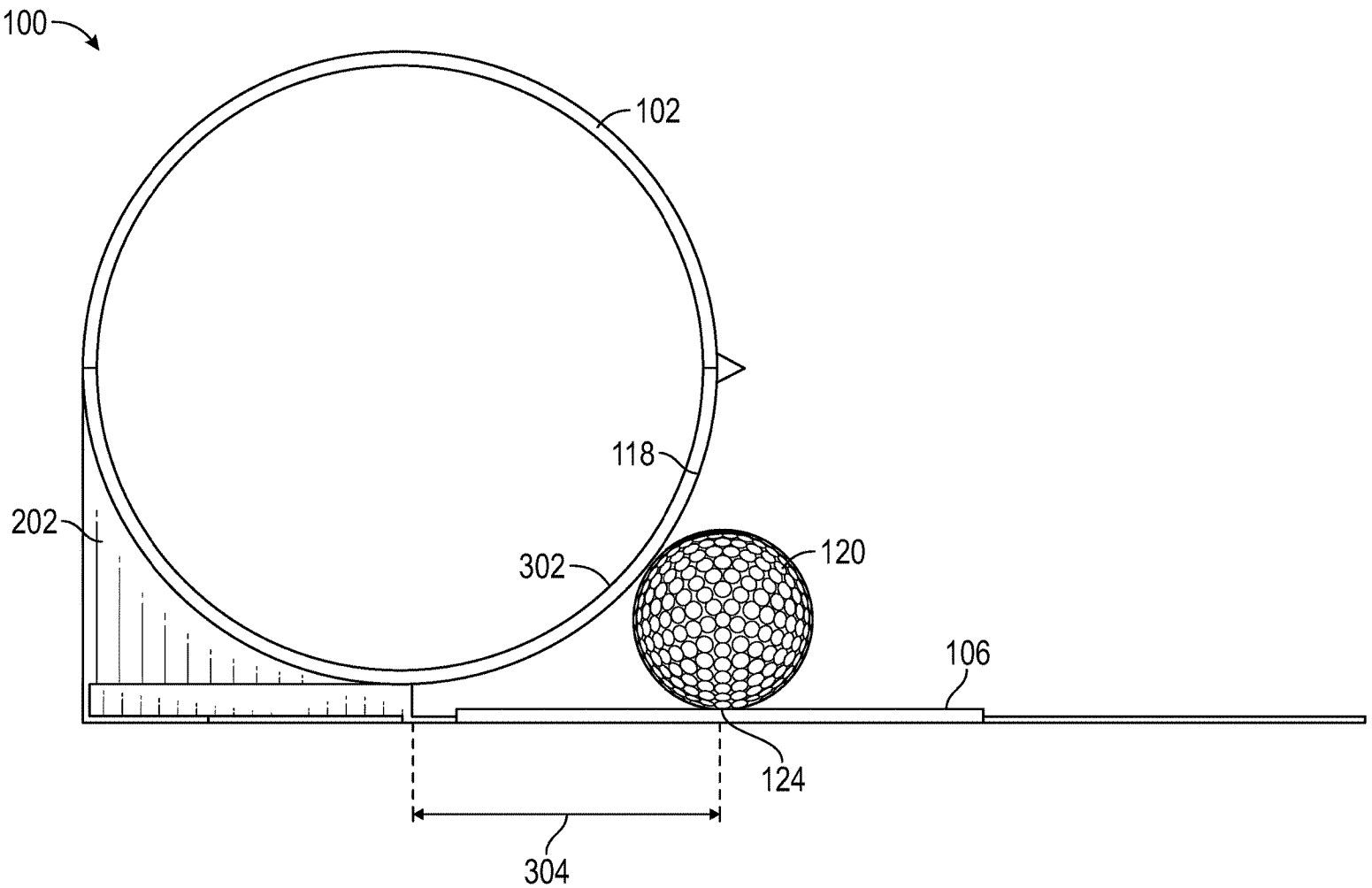
FIG. 3 is a cross-sectional side view of the putting aid of FIG. 1.
Figure 4:
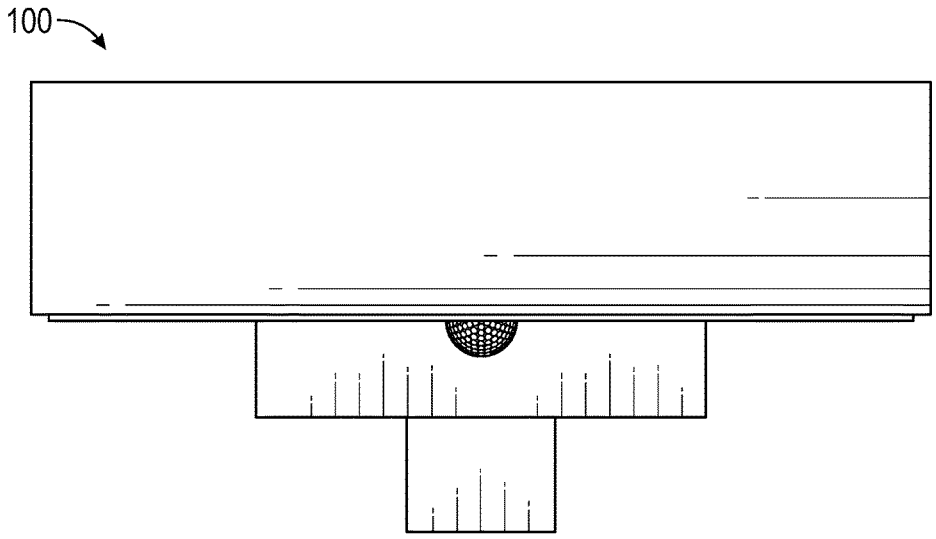
FIG. 4 is a top view of the putting aid of FIG. 1.
Figure 5:
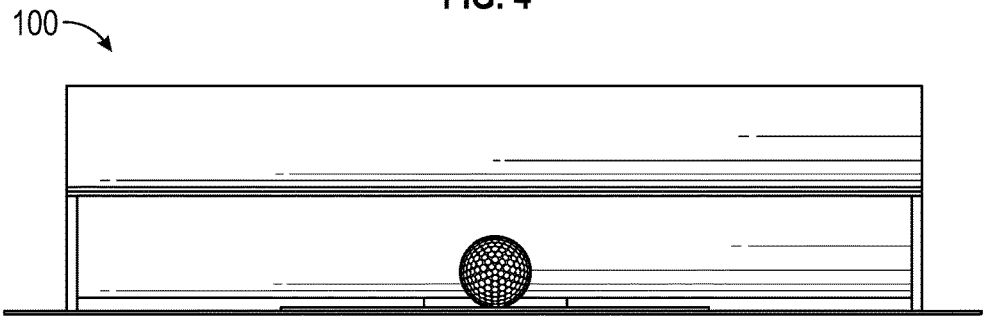
FIG. 5 is a front view of the putting aid of FIG. 1.
Figure 6:
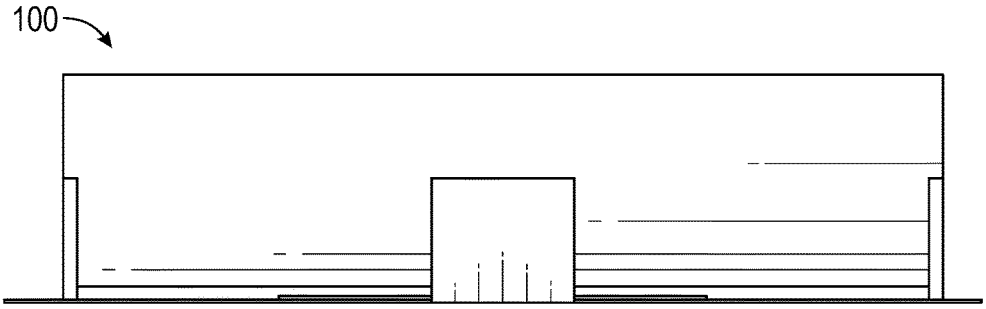
FIG. 6 is a rear view of the putting aid of FIG. 1.

FIGS. 3-6 further depict the putting aid 100. More specifically, FIG. 3 is a cross-sectional side view of the putting aid 100 that illustrates the golf ball 120 resting on the dimple 124 of the putting pad 106 and the dimple 124 being spaced apart from a base 302 of the at least partial cylinder 102 by a distance 304. The dimple 124 is spaced apart from the at least partial cylinder 102 resting on the sleeve stand 202 by the distance 304 to facilitate the cylindrical surface 118 of the at least partial cylinder 102 in engaging the distal end of the golf club through the putting motion that puts the golf ball 120. Further, FIG. 4 is a top view of the putting aid 100, FIG. 5 is a front view of the putting aid 100, and FIG. 6 is a rear view of the putting aid 100.

Figure 7:
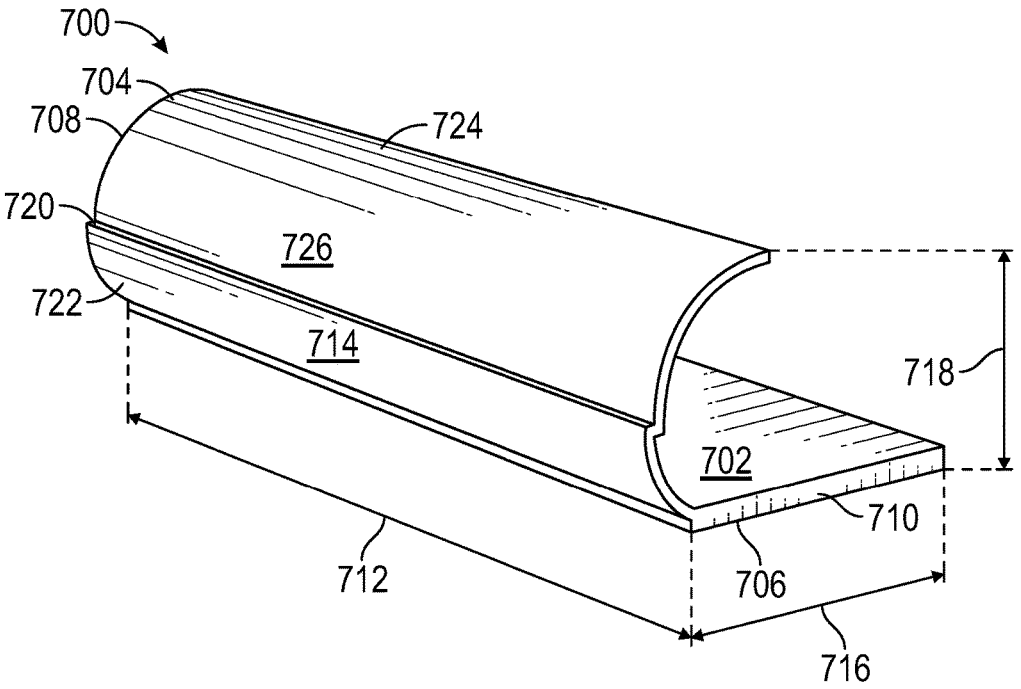
FIG. 7 is a perspective view of another example putting aid in accordance with the teachings herein.

FIG. 7 illustrates another example putting aid 700 in accordance with the teachings herein. The putting aid 700 includes a base 702 and a curved body 704 (also referred to as a "rounded body"). The base 702 is configured to rest on a ground surface and the curved body 704 is supported by the base 702. In the illustrated example, the base 702 and the curved body 704 are integrally formed. For example, the putting aid 700 is formed via an injection molding process without any assembly of components of the putting aid 700.

As illustrated in FIG. 7, the base includes a flat surface 706 that is configured to engage the ground surface to enable the base 702 to securely rest on the ground surface. The base 702 has a first end 708 and a second end 710 opposite the first end 708. In the illustrated example, a length 712 of the putting aid 700 extends between the first end 708 and the second end 710 of the base 702.

The curved body 704 extends in a direction between the first end 708 and the second end 710 of the base 702. In the illustrated example, the curved body 704 extends the length 712 of the putting aid 700 between the first end 708 and the second end 710. As illustrated in FIG. 7, the curved body 704 defines a convex surface 714 (also referred to as a "curved surface" and a "rounded surface"). For example, the curved body 704 includes an at least partial cylinder such that the convex surface 714 is at least partially cylindrical. The curved body 704 extends in the direction between the first end 708 and the second end 710 of the base 702. In the illustrated example, the convex surface 714 extends the length 712 of the putting aid 700.

In operation, the base 702 is placed to on the ground surface. When the base 702 is on the ground surface, the convex surface 714 of the curved body 704 is configured to engage a distal end of a golf club (e.g., a toe or nose of a putter head opposite a heal of the putter head). That is, the convex surface 714 is positioned relative to the ground surface to engage the toe or nose of the putter head. For example, upon placing the base 702 on the ground surface, the user places a golf ball on the ground surface next to the convex surface 714. For example, the user places the golf ball on the ground surface such that a portion of the golf ball contacts and/or is otherwise adjacent to a portion of the convex surface 714 that is located at and/or near a midway point of the length 712 of the putting aid 700. Further, the user positions his or her feet next to the putting aid 700 such that the user's feet are substantially perpendicular to the curved body 704 and the golf ball is positioned between the user's feet and the curved body 704. The user then places the putter head behind the golf ball such that the toe or nose of the putter head contacts the convex surface 714 of the of the curved body 704. In turn, the toe or nose of the putter head of the golf club is able to slide along the convex surface 714 as the user putts the golf ball in a direction parallel to the length 712 of the putting aid 700.

During operation, the putting aid 700 guides the user in performing a desired putting motion by causing the toe or nose of the putter head to slide along the convex surface 714 of the curved body 704 through the entirety of the putting motion. That is, the putting aid 700 trains the user to develop a putting motion (e.g., an inside-to-inside stroke, an inside-down-the-line stroke, a straight-back-straight-through stroke) that consistently results in solid contact with a golf ball. For example, the putting aid 700 causes a user to intuitively develop and retain (e.g., via muscle-memory) a putting motion that consistently results in a center portion of a face of a putter head contacting a golf ball. Furthermore, the putting motion developed via the putting aid 700 causes a face of a putter head to remain relatively low throughout a putting motion to prevent a golfer from coming out of the putting motion early and, thus, contacting a golf ball with a lower portion of the face of the putter head that potentially does not consistently result in solid contact with the golf ball.

In the illustrated example, the curved body 704 is formed of a low-friction material (i.e., material having a low friction coefficient) to enable the toe or nose of the putter head to slide along the convex surface 714 without impediment. For example, the material of the curved body 704 that defines the convex surface 714 includes a low-friction plastic, such as polyoxymethylene, silicone, nylon, high-density polyethylene (HDPE), ultra-high-molecular-weight polyethylene (UHMW), acrylic (also referred to as poly(methyl methacrylate), PMMA, and acrylic glass), etc.

As illustrated in FIG. 7, the base 702 and the curved body 704 defines the length 712, a width 716, and a height 718 of the putting aid 700. In some examples, the length 712 is long enough to exceed a typical putting stroke of a golfer. Further, the length 712 is greater than the width 716 and the width 716 is greater than the height 718 to provide stability to the putting aid 700 as the user performs the putting motion along the convex surface 714. Additionally or alternatively, the base 702 includes spikes that are configured to extend into the ground surface to secure the putting aid 700 during use.

Further, the curved body 704 of the illustrated example includes a visual aid 720 that extends along the curved body 704 in a direction along the length 712 of putting aid 700 to facilitate a user in observing his or her putting motion while using the putting aid 700. In the illustrated example, the visual aid 720 divides the curved body 704 into a lower portion 722 and an upper portion 724. For example, the lower portion 722 defines the convex surface 714 that engages a toe or nose of a putter head to guide a putting motion of a user, and the upper portion 724 defines a second convex surface 726. Additionally or alternatively, the putting aid 700 includes a reflective surface, such as a portion of the convex surface 714 and/or the second convex surface 726, to facilitate a user in observing his or her putting motion.

Figure 8:
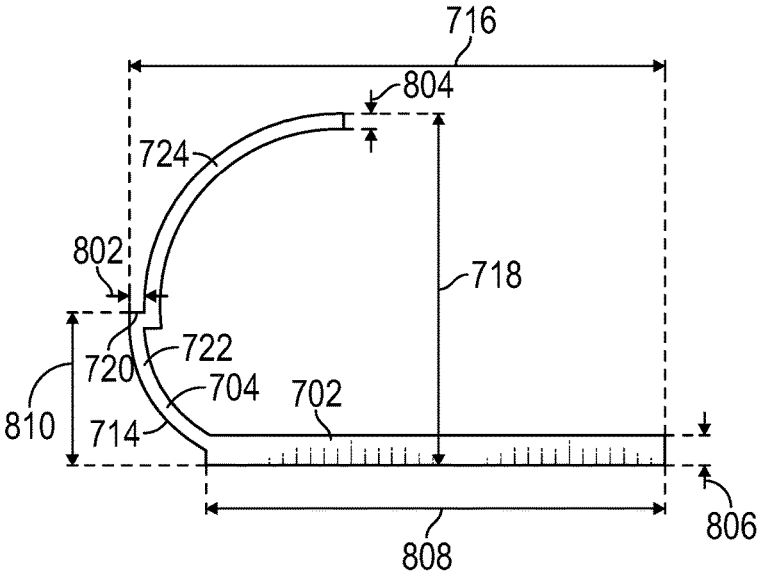
FIG. 8 is a side view of the putting aid of FIG. 7.

FIG. 8 is a side view that further depicts the putting aid 700. As illustrated in FIG. 8, the curved body 704 includes an arm that protrudes from an edge of the base 702 in a direction (e.g., a substantially upward direction) away from the flat surface 706 of the base 702 in such a manner that a gap or channel is formed between the base 702 and the curved body 704. For example, the lower portion 722 of the curved body 704 extends from the base 702 to the visual aid 720, and the upper portion 724 extends from the visual aid 720 in a direction away from the lower portion 722. In the illustrated example, the visual aid 720 is integrally formed with the curved body 704 such that the lower portion 722, the visual aid 720, and the upper portion 724 are integrally formed as a single arm protruding from the base 702. For example, the visual aid 720 is a ledge that is defined by the lower portion 722 protruding beyond the upper portion 724 of the curved body 704 in a direction away from and parallel to the base 702. The ledge has a width 802 that is defined by the lower portion 722 and the upper portion 724 of the curved body 704.

In the illustrated example, the each of the lower portion 722 and the upper portion 724 have a thickness 804. That is, the lower portion 722 and the upper portion 724 have the same thickness (i.e., the thickness 804). Further, in some examples, the width 802 of the visual aid 720 is substantially similar and/or identical to the thickness 804 of the lower portion 722 and the upper portion 724. In other examples, the lower portion 722 may have a different thickness than the upper portion 724 and/or the width 802 of the visual aid 720 may be different than the thickness 804. Further, in the illustrated example, the convex surface 714 of the lower portion 722 is a partially cylindrical surface that has a same radius as a partially cylindrical surface of the second convex surface 726 of the upper portion 724. In other examples, the lower portion 722 and the upper portion may have different radii and/or may be non-partially-cylindrically shaped.

As illustrated in FIG. 8, the putting aid 700 has the width 716 and the height 718. Further, the base 702 includes a thickness 806 that is less than the height 718 of the putting aid 700 and a width 808 that is less than the width 716 of the putting aid 700. In the illustrated example, the base 702 is thicker than the curved body 704 to stabilize the putting aid 700 when the putting aid 700 is resting on the ground surface. That is, in the illustrated example, the thickness 806 of the base 702 is greater than the thickness 804 of the curved body 704. Further, the convex surface 714 has a radial length extending between the base 702 and the visual aid 720 that enables the convex surface 714 to engage a toe or nose of a putter head during a putting motion of a user. For example, the distance between the visual aid 720 and the flat surface 706 of the base 702 forms a height 810 that enables the toe or nose of the putter head to engage the convex surface 714 of the lower portion 722 during a putting motion.

Figure 9:
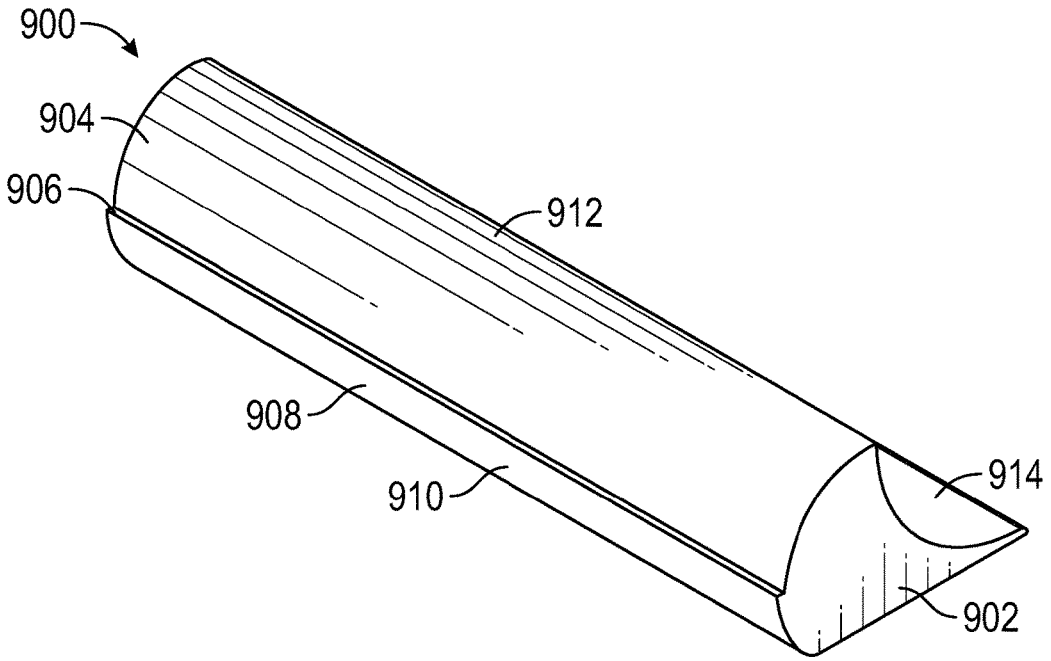
FIG. 9 is a perspective view of another example putting aid in accordance with the teachings herein.

FIG. 9 illustrates another example putting aid 900 in accordance with the teachings herein. As illustrated in FIG. 9, the putting aid 900 includes a base 902, a curved body 904, and a visual aid 906. Further, the curved body 904 includes a lower portion 908, a convex surface 910, and an upper portion 912. The base 902, the curved body 904, the visual aid 906, the lower portion 908, the convex surface 910, and the upper portion 912 of the putting aid 900 include features that are substantially similar and/or identical to those of the base 702, the curved body 704, the visual aid 720, the lower portion 722, the convex surface 714, and the upper portion 724 of the putting aid 700, respectively. Because those features of the putting aid 700 are described in detail in connection with FIGS. 7-8, some of those features of the putting aid 900 of FIG. 9 are not described in further detail below In the illustrated example, the base 902 and the curved body 904 are integrally formed. Further, the visual aid 906 is integrally formed with the curved body 904. As illustrated in FIG. 9, the curved body 904 protrudes from the base 902 in an upward manner opposite a flat surface that is configured to engage a ground surface. For example, the curved body 904 protrudes from the base 902 in such a manner as to have a fin-shaped cross-section that is formed from the convex surface 910 and an opposing concave surface 914 of the curved body 904.

Figure 10:
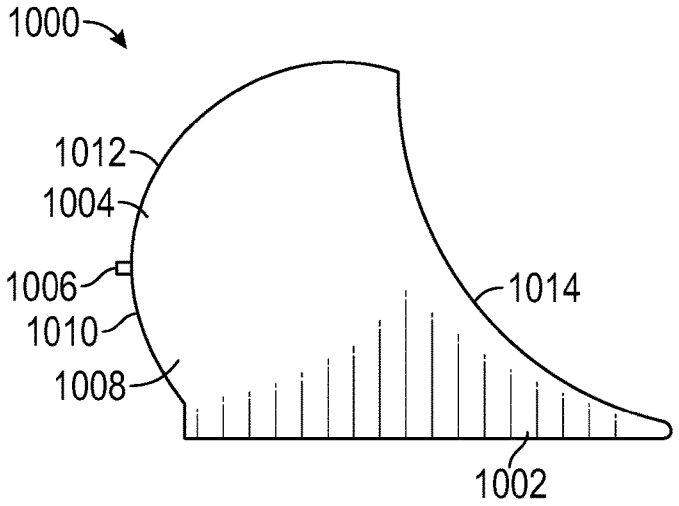
FIG. 10 is a side view of another example putting aid in accordance with the teachings herein.

FIG. 10 illustrates another example putting aid 1000 in accordance with the teachings herein. As illustrated in FIG. 10, the putting aid 1000 includes a base 1002, a curved body 1004, and a visual aid 1006. Further, the curved body 1004 includes a lower portion 1008, a convex surface 1010, and an upper portion 1012. The base 1002, the curved body 1004, the visual aid 1006, the lower portion 1008, the convex surface 1010, and the upper portion 1012 of the putting aid 1000 include features that are substantially similar and/or identical to those of the base 702, the curved body 704, the visual aid 720, the lower portion 722, the convex surface 714, and the upper portion 724 of the putting aid 700, respectively. Because those features of the putting aid 700 are described in detail in connection with FIGS. 7-8, some of those features of the putting aid 1000 of FIG. 10 are not described in further detail below.

As illustrated in FIG. 10, the base 1002 and the curved body 1004 are integrally formed. The curved body 1004 protrudes from the base 1002 in an upward manner opposite a flat surface that is configured to engage a ground surface. In the illustrated example, the lower portion 1008 and the upper portion 1012 of the base form an at least partial cylinder. Further, the curved body 1004 includes a concave surface 1014 that is opposite the convex surface 1010 defined by the lower portion 1008 and the upper portion 1012. Additionally, the visual aid 1006 of the illustrated example is coupled to the curved body 1004 via an adhesive and/or a fastener.

An example disclosed golf putting aid includes a base configured to rest on a ground surface. The base has a first end and a second end opposite the first end. The example disclosed golf putting aid also includes a curved body supported by the base and defining a convex surface that extends in a direction between the first end and the second end of the base. When the base is rested on the ground surface, the convex surface is positioned relative to the ground surface to engage a toe of a putter head of a golf club as a user performs a putting motion to guide the putting motion.

In some examples, to enable the toe of the putter head to slide along the convex surface during the putting motion, the curved body is formed of a low-friction material selected from the group consisting of acrylic, polyoxymethylene, silicone, nylon, and high-density polyethylene.

In some examples, the base and the curved body define a length, a width, and a height of the golf putting aid. The length is greater than the width and the width is greater than the height to provide stability to the golf putting aid as the user performs the putting motion along the convex surface. In some such examples, the length extends between first end and the second end of the base.

In some examples, the base and the curved body are integrally formed. In some examples, the base is thicker than the curved body to stabilize the golf putting aid when the base is resting on the ground surface. In some examples, the base includes a flat surface configured to engage the ground surface.

Some examples further include a visual aid extending along the curved body to facilitate the user in observing the putting motion. In some such examples, the visual aid is integrally formed with the curved body. In some such examples, the visual aid divides the curved body into a lower portion and an upper portion. Further, in some such examples, the visual aid is a ledge and the lower portion protrudes beyond the upper portion to define the ledge. Further, in some such examples, the lower portion defines the convex surface that guides the putting motion of the user. Further, in some such examples, the upper portion defines a second convex surface. Moreover, in some such examples, the convex surface and the second convex surface are defined by a same radius of curvature. Further, in some such examples, the lower portion has a same thickness as the upper portion. In some such examples, the convex surface has a radial length extending between the base and the visual aid that enables the convex surface to engage the toe of the putter head during the putting motion of the user.

Another example disclosed golf putting aid includes a base configured to rest on a ground surface. The base has a first end and a second end opposite the first end. The example disclosed golf putting aid also includes a rounded body supported by the base and having a guiding surface. The guiding surface is at least partially cylindrical and extends in a direction between the first end and the second end of the base. When the base is rested on the ground surface, the guiding surface is positioned relative to the ground surface to engage a toe of a putter head of a golf club as a user performs a putting motion to guide the putting motion.

Some examples further include a reflective surface to facilitate the user in observing the putting motion guided by the guiding surface. Some examples further include a visual aid that extends along a length of the rounded body to facilitate the user in observing the putting motion. In some examples, to enable the toe of the putter head to slide along the guiding surface during the putting motion, the rounded body is formed of a low-friction material selected from the group consisting of acrylic, polyoxymethylene, silicone, nylon, and high-density polyethylene.

Another example disclosed golf putting aid includes at least a partial cylinder having a cylindrical surface extending in a direction along a ground surface. The cylindrical surface is to engage a distal end of a golf club as a user performs a putting motion. The example disclosed golf putting aid also includes one or more stands on which the at least the partial cylinder rests and a putting pad on the ground surface adjacent to the at least the partial cylinder. The putting pad defines a dimple on which a golf ball is to rest. The dimple is spaced apart from the at least the partial cylinder by a distance to facilitate the cylindrical surface in engaging the distal end of the golf club to guide the putting motion of the user.

In some examples, the putting pad includes a reflective surface to facilitate the user in observing the putting motion. In some examples, the at least the partial cylinder includes a visual aid extending along a length of the at least the partial cylinder to facilitate the user in observing the putting motion. In some examples, the at least the partial cylinder is formed of a low-friction material including at least one of polyoxymethylene, silicone, nylon, and high-density polyethylene to enable the distal end of the golf club to slide along the cylindrical surface during the putting motion.

In some examples, the one or more stands includes a first end stand and a second end stand. In some such examples, a first end of the at least the partial cylinder rests on the first end stand and a second end of the at least the partial cylinder rests on the second end stand.

In some examples, the one or more stands includes a sleeve stand on which a middle portion of the at least the partial cylinder rests. Some such examples further include a slide that couples to the sleeve stand and rests on the ground surface adjacent to the at least the partial cylinder. Further, in some such examples, the slide defines a channel that receives the putting pad. Moreover, in some such examples, the channel is wider than the putting pad to facilitate adjustment of a position of the putting pad relative to the at least the partial cylinder.

In some examples, the one or more stands include fasteners that facilitate the one or more stands in coupling to the ground surface. In some such examples, the at least the partial cylinder is a canister configured to store the one or more stands and the putting pad in storage.

Another example disclosed golf putting aid includes at least a partial cylinder having a cylindrical surface configured to extend in a direction along a ground surface. The cylindrical surface is configured to engage a distal end of a golf club as a user performs a putting motion. The example disclosed golf putting aid also includes one or more stands on which the at least the partial cylinder is configured to rest and a putting pad configured to be positioned on the ground surface adjacent to the at least the partial cylinder. The putting pad defines a dimple configured to receive a golf ball and be spaced apart from the at least the partial cylinder by a distance to facilitate the cylindrical surface in engaging the distal end of the golf club to guide the putting motion of the user.

In some examples, the one or more stands includes a first end stand and a second end stand. The first end stand is configured to receive a first end of the at least the partial cylinder and the second end stand is configured to receive a second end of the at least the partial cylinder.

In some examples, the one or more stands includes a sleeve stand configured to receive a middle portion of the at least the partial cylinder. Some such examples further include a slide configured to couple to the sleeve stand and rest on the ground surface adjacent to the at least the partial cylinder. Further, in some such examples, the slide defines a channel configured to receive the putting pad and position the putting pad relative to the at least the partial cylinder.

In some examples, the at least the partial cylinder, the one or more stands, and the putting pad are configured to disassemble for storage. In some such examples, the at least the partial cylinder is a canister that is configured to store the one or more stands and the putting pad. Some such examples further include an end cap configured to couple to an end of the at least the partial cylinder to enclose the one or more stands and the putting pad stored in a cavity of the at least the partial cylinder.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment (s) without substantially departing from the spirit and principles of the techniques described herein. All modifications are intended to be included herein within the scope of this disclosure and protected by the following claims.

What is claimed is:

1. A golf putting aid comprising:

a base configured to rest on a ground surface, the base including a flat surface configured to engage the ground surface, the base having a first end and a second end opposite the first end; and a curved body supported by the base and defining a convex surface that extends in a direction between the first end and the second end of the base, wherein, when the base is rested on the ground surface, the convex surface is positioned relative to the ground surface to engage a toe of a putter head of a golf club as a user performs a putting motion to guide the putting motion.

2. The golf putting aid of claim 1, wherein, to enable the toe of the putter head to slide along the convex surface during the putting motion, the curved body is formed of a low-friction material selected from the group consisting of acrylic, polyoxymethylene, silicone, nylon, and high-density polyethylene.

3. The golf putting aid of claim 1, wherein the base and the curved body define a length, a width, and a height of the golf putting aid, wherein the length is greater than the width and the width is greater than the height to provide stability to the golf putting aid as the user performs the putting motion along the convex surface.

4. The golf putting aid of claim 3, wherein the length extends between first end and the second end of the base.

5. The golf putting aid of claim 1, wherein the base and the curved body are integrally formed.

6. The golf putting aid of claim 1, further including a visual aid extending along the curved body to facilitate the user in observing the putting motion.

7. The golf putting aid of claim 6, wherein the visual aid is integrally formed with the curved body.

8. The golf putting aid of claim 6, wherein the visual aid divides the curved body into a lower portion and an upper portion.

9. The golf putting aid of claim 8, wherein the lower portion defines the convex surface that guides the putting motion of the user.

10. The golf putting aid of claim 8, wherein the upper portion defines a second convex surface.

11. The golf putting aid of claim 10, wherein the convex surface and the second convex surface are defined by a same radius of curvature.

12. The golf putting aid of claim 8, wherein the lower portion has a same thickness as the upper portion.

13. The golf putting aid of claim 6, wherein the convex surface has a radial length extending between the base and the visual aid that enables the convex surface to engage the toe of the putter head during the putting motion of the user.

14. A golf putting aid comprising:

a base configured to rest on a ground surface, the base having a first end and a second end opposite the first end; and a curved body supported by the base and defining a convex surface that extends in a direction between the first end and the second end of the base, wherein the base is thicker than the curved body to stabilize the golf putting aid when the base is resting on the ground surface, wherein, when the base is rested on the ground surface, the convex surface is positioned relative to the ground surface to engage a toe of a putter head of a golf club as a user performs a putting motion to guide the putting motion.

15. The golf putting aid of claim 14, wherein the base includes a flat surface configured to engage the ground surface.

16. A golf putting aid comprising:

a base configured to rest on a ground surface, the base having a first end and a second end opposite the first end;

a curved body supported by the base and defining a convex surface that extends in a direction between the first end and the second end of the base; and a visual aid extending along a curved body to facilitate a user in observing a putting motion, wherein the visual aid divides the curved body into a lower portion and an upper portion, wherein the visual aid is a ledge, wherein the lower portion protrudes beyond the upper portion to define the ledge, wherein, when the base is rested on the ground surface, the convex surface is positioned relative to the ground surface to engage a toe of a putter head of a golf club to guide the putting motion of the user.

17. A golf putting aid comprising:

a base configured to rest on a ground surface, the base including a flat surface configured to engage the ground surface, the base having a first end and a second end opposite the first end; and a rounded body supported by the base and having a guiding surface, the guiding surface is at least partially cylindrical and extends in a direction between the first end and the second end of the base, wherein, when the base is rested on the ground surface, the guiding surface is positioned relative to the ground surface to engage a toe of a putter head of a golf club as a user performs a putting motion to guide the putting motion.

18. The golf putting aid of claim 17, further including a reflective surface to facilitate the user in observing the putting motion guided by the guiding surface.

19. The golf putting aid of claim 17, further including a visual aid that extends along a length of the rounded body to facilitate the user in observing the putting motion.

20. The golf putting aid of claim 17, wherein, to enable the toe of the putter head to slide along the guiding surface during the putting motion, the rounded body is formed of a low-friction material selected from the group consisting of acrylic, polyoxymethylene, silicone, nylon, and high-density polyethylene.

* * * * *